United States Patent [19]

Hauger et al.

[11] Patent Number: 4,475,689

[45] Date of Patent: Oct. 9, 1984

[54] VARIABLE DILUTION RATIO HOSE-END SPRAYER

[75] Inventors: Harry L. Hauger; Glenn I. Beal, both of Somerset, Pa.

[73] Assignee: R. M. Smith, Inc., Somerset, Pa.

[21] Appl. No.: 448,387

[22] Filed: Dec. 9, 1982

[51] Int. Cl.³ ..... B05B 7/30

[52] U.S. Cl. ..... 239/318; 239/396

[58] Field of Search ..... 239/318, 354, 396

[56] References Cited

U.S. PATENT DOCUMENTS

| | | | |
|---|---|---|---|
| 3,191,869 | 6/1965 | Gilmour | 239/318 |
| 3,770,205 | 11/1973 | Proctor | 239/318 X |
| 3,940,069 | 2/1976 | Gunzel | 239/318 |
| 4,349,157 | 9/1982 | Beiswenger et al. | 239/318 X |

FOREIGN PATENT DOCUMENTS

| | | | |
|---|---|---|---|
| 1363426 | 5/1964 | France | 239/318 |

*Primary Examiner*—Andres Kashnikow

*Attorney, Agent, or Firm*—Reed, Smith, Shaw & McClay

[57] ABSTRACT

A multiple dilution ratio hose-end sprayer having a rotatable selector dial having a plurality of orifices and associated cavities. The orifices are adapted to intersect a fluid passageway extending from a fluid container to a mixing chamber used for mixing selected amounts of fluid from the container with water entering the mixing chamber. Water is supplied to the mixing chamber through a first and second spaced apart nozzles, an annular channel extending from between said nozzles to an intersecting channel adapted to communicate with a cavity associated with an orifice intersecting said fluid passageway. The nozzle opening from said second nozzle being smaller than the discharge opening for the sprayer, but preferably equal to or smaller than opening from the first nozzle.

11 Claims, 8 Drawing Figures

VARIABLE DILUTION RATIO HOSE-END SPRAYER

FIELD OF THE INVENTION

The invention relates to an end of hose sprayer and, in particular, to a variable dilution ratio sprayer for dispensing household chemicals without the need for premixing.

BACKGROUND OF THE INVENTION

Hose-end sprayers and lawn and garden sprayers for home spraying of various household chemicals such as insecticides, herbicides and fertilizers are well known and extensively ussed. Basically, such units are relatively simple and inexpensive, using the domestic water pressure from a garden hose to power the spray. Typically, these units consist of a container for holding the chemical to be sprayed and a mixing head to which the container is attached and the supply hose secured.

In general, the mixing head is connected to the chemicals in the container by means of a siphon tube which extends from a mixing chamber into the bottom of the container. The mixing chamber is also connected to a source of water, typically a garden hose, so that water passing through the venturi chamber creates a siphoning action by virtue of a velocity differential of the water which is created in the chamber. The basis of operation of virtually all such unit sprayers is Bernoulli's principle.

Most hose-end sprayers have only one dilution ratio. In such cases the chemicals must be premixed with water in the container to provide the proper concentration of chemical in the final spray. Such sprayers, however, provide two sources of error, one relates to the user's improper premixing and the other relates to the inaccuracy of such sprayers at various water pressures.

A number of commercially available sprayers do provide for multiple dilution ratios. Multiple ratio sprayers typically do not require chemical premixing and directly provide the desired concentration of chemical in the spray. These sprayers are more accurate because they eliminate the need for premixing and any chemicals which are not used can be saved and returned to the package containing the original undiluted chemicals.

Multiple ratio sprayers provide ratio variation by either selectively proportioning the size of the opening in the passageway that extends from the container to the mixing chamber or by varying the size of the air vent opening which controls the siphoning of the fluid from the container. In both cases, a multiple orificed selector, such as a rotatable wheel or slideable stem interposed in the passageway or vent, is used to select the dilution ratio. In practice, it has been found that multiple ratio sprayers that control the air vent orifice size to vary the dilution ratio are not as accurate as those which vary the size of the fluid opening between the container and the mixing chamber. However, the sprayers which vary the size of fluid opening and to some extent those controlling the air vent, are susceptible to plugging caused by chemicals drying in the control orifice rendering them inaccurate or inoperable. Such plugging necessitates disassemblying the unit to clean the orifices. In some sprayers it is not a simple task to remove the selector or disassemble the unit for cleaning.

Illustrative of prior art multiple ratio sprayers are U.S. Pat. Nos. 3,112,884 and 3,191,869.

Accordingly, it is an object of the present invention to provide a multiple ratio hose-end sprayer having a multiple fluid orifice selector dial which is easy to remove for cleaning, but precisely alignable in operation to provide accurate dilution ratios. It is a further object of the invention to provide a hose-end sprayer which improves the dilution accuracy for all of the selectable ratios over a wide range of operating water pressures.

SUMMARY OF THE INVENTION

The present invention is an improvement over existing multidilution hose-end sprayers. Generally, the present invention comprises a mixing head having a mixing chamber for dilution of a chemical fluid with water. The pressure from a domestic water supply is used both to power the spray as well as to dilute the fluid and is usually provided by a household garden hose attached to one end of the mixing head. Water passes to a mixing chamber in the mixing head via a channel positioned in the stem of the mixing head. An anti-siphon device is interposed within the channel to prevent chemically entrained water from being drawn back into the hose or water supply system by a sudden loss of water pressure.

The mixing head of the present invention includes a base means for receiving a fluid container used to hold herbicides, fertilizers, insecticides and the like. Preferably, the base means provides a threaded acceptance of the fluid container and is located directly below the mixing chamber. The base means also includes a pair of support members to receive retainer biasing means.

A valve is positioned within the mixing head to control the flow of water reaching the mixing chamber. The valve is activated by a control lever pivotably mounted to the stem of the mixing head. The control valve is preferably positioned adjacent to the entrance to the mixing chamber.

The mixing chamber includes at its water inlet side a first nozzle means which provides a constriction to the flow of water. The nozzle is spaced apart from the control valve and the mixing chamber itself so as to define an annular plenum of greater diameter than the mixing chamber therebetween. Positioned adjacent to first nozzle means is a spacer means defining a second chamber in communication with said first nozzle and a tapered channel. Said spacer means is spaced apart from the inner wall of the nozzle portion to define an annular passageway therebetween and includes a straight portion between the tapered channel and outlet. Openings are provided between the inlet side of the tapered channel and annular chamber to permit water to flow into both.

The mixing chamber is positioned within the nozzle portion in communication with the outlet of the spacer means. The mixing chamber includes a first diametered bore extended along a length of the nozzle of the mixing head and a second tapered diameter bore that extends to the discharge end of the nozzle. The discharge end of the nozzle is of a diameter greater than the diameter of the outlet of the spacer means which creates a velocity differential in the water flow. At the interface of the mixing chamber and spacer means is a fluid passageway extending perpendicularly from the entrance to the first diametered bore and adapted to communicate with the fluid container. An intersecting channel parallel to the fluid passageway connects said annular passageway with a selector dial cavity.

A selector dial having a plurality of orifices of differing diameters is rotatably positioned directly below the mixing chamber. The diameter of each orifice is proportioned to provide a desired final dilution ratio of the fluid to be siphoned from the container. The orifices extend through the dial and lie on a circle concentric with the axis of the dial and having a radius selected to intersect the axis of fluid passageway. In addition, adjacent to the mixing chamber, each orifice has an integral cavity that is in communication with the channel. Each cavity may be proportioned together with the orifice to provide the desired dilution ratio. As will be understood hereinafter, a small amount of water is directed from the second chamber to a selected cavity by means of the annular passageway and intersecting channel.

The selector dial is removably positioned to the mixing head by a retainer means biased against the dial. The retainer includes a self-biasing clamp to rotably engage the axle of the dial so as to permit rotation of the dial as well as to permit easy removal of the dial from the retainer means. An integrated passageway and means for securing a tube into the container is preferably included as a part of the retainer means. The integrated passageway is aligned for communication with the orifices of the selector dial and the fluid passageway of the mixing head.

Rotation of the selector dial to a desired indicia setting located on the top of the dial provides the desired dilution ratio of the chemical to be sprayed. By opening the water valve positioned in the mixing head, water is permitted to flow through the mixing chamber. Because of the difference in diameter in the first and second bores, a partial vacuum is created in the fluid passageway causing the fluid in the container to be siphoned into the mixing chamber for dilution with the water. While the present invention will work satisfactorily with water pressures between 20 and 80 psi, it is more preferable to maintain the pressure at between 40 to 60 psi.

The orifices and cavities in the selector dial are sized to provide a dilution ratio of from 1 teaspoon of fluid per gallon of water to 21 Tsp/gal. Typically, a number of different ratios are provided on the selector dial. However, because the dial is easily removable, interchangeable dials may be used to provide a wider variety of dilution ratios including metric measures. Other advantages of the present invention will become apparent from a perusal of the following detailed description of a presently preferred embodiment taken in connection with the accompanying drawings.

PRESENTLY PREFERRED EMBODIMENT

Figure 1:
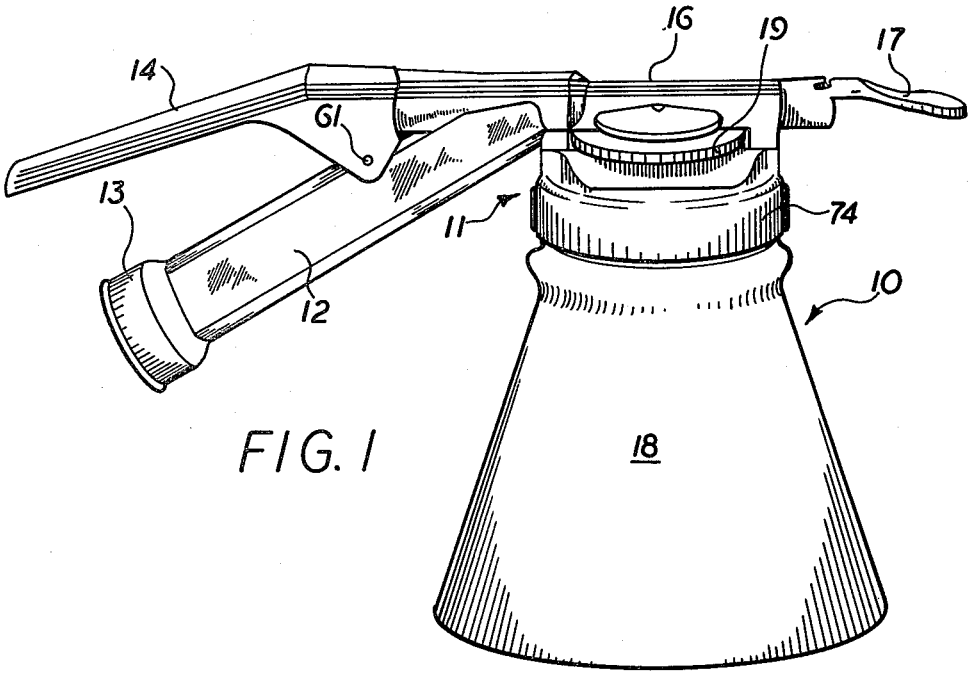
FIG. 1 is a perspective view of the hose-end sprayer of the present invention together with a fluid container.
Figure 2:
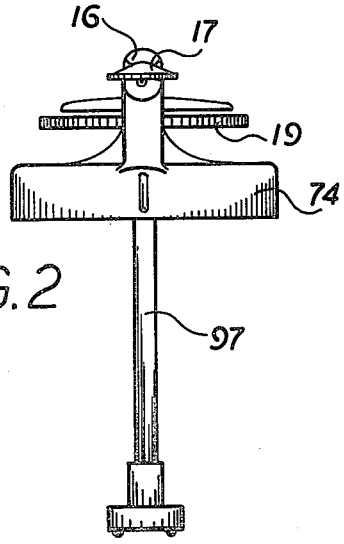
FIG. 2 is a front elevation of the hose-end sprayer with the container tube attached, but without the container.

With reference to FIGS. 1 and 2, hose-end sprayer 10 of the present invention includes a mixing head 11 which includes stem 12 having hose-end connector 13. Preferably, mixing head 11 and stem 12 made from a molded plastic or may be cast from a metal such as aluminum or zinc. Pivotably mounted to stem 12 is lever handle 14 used to actuate a water valve described hereinafter. Mixing head 11 includes nozzle portion 16 having spray deflector 17. Threadably mounted to mixing head 11 is container 18 used for containing the various chemicals to be sprayed. Rotatably secured to mixing head 11 is dial selector 19 used to select the dilution ratios for the spray.

Figures 3, 3A:
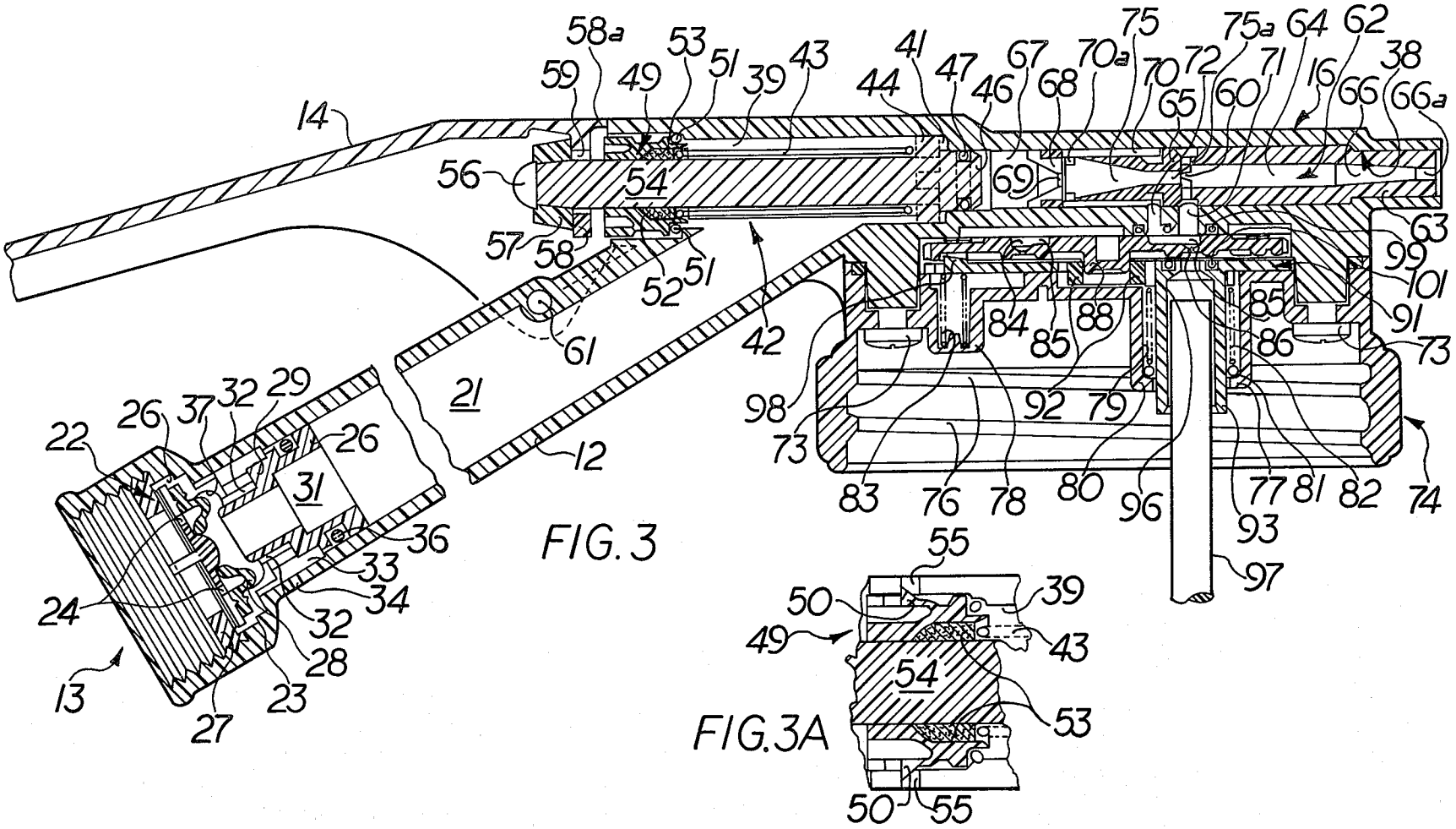
FIG. 3 is a sectional elevation of the mixing head of the present invention.
FIG. 3A is a sectional elevation of the water valve.

With reference to FIG. 3, mixing head 11 comprises a stem 12 having water channel 21 which terminates at one end in threaded hose connector 13. Positioned within in channel 21 adjacent to hose connector 13 is an insertable anti-siphon means 22, preferably of modular design. Anti-siphon means 22 consist of a retainer disc 23 having a plurality of water openings 24 on a circle concentrically spaced from the axis of disc 23. Disc 23 is within housing 26. Housing 26 is retained within hose connector end 13 by means of hose washer 27.

A diaphragm 28, preferably made of rubber or other elastomerical material is positioned between retaining disc 23 and housing 26. Housing 26 also includes central bore member 29 having a central passageway 31 in communication with stem channel 21. Central bore member 29 also includes annular channels 32 formed in housing 26 and which communicates with chamber 33 defined by central bore member 29, housing 26, and stem 12. Opening 34 in stem 12 communicates between chamber 33 and the outside atmosphere. Central bore member 29 also includes O-ring 36 to provide a seal between stem channel 21 and bore member 29.

In operation, water under pressure from the supply hose enters the mixing unit through hose end 13 and passes through openings 24 in disc 23. The water pressure forces open diaphragm 28 and presses it against shoulder 37 of housing 26 to sealingly close annular channels 32. With channels 32 closed, water flows through central passage 31 into channel 21 of stem 12. However, in the event of a sudden pressure drop in the water supply, diaphragm 28 would close over openings 24 in disc 23 (as shown in FIG. 3) by a partial vacuum created in the hose. In that case, any contaminated fluid from the mixing chamber would drain into the annular channels 32 and chamber 33 for discharge through opening 34. Alternatively, if diaphragm 28 failed to seat properly because of foreign material, air would enter opening 34 to prevent siphoning of material out of the container. Anti-siphon means 22, therefore, prevents the backflow of contaminated or mixed water/chemicals into a water supply system.

Mixing head 11 includes nozzle portion 16. Nozzle 16 includes a front portion 38 comprising the mixing chamber insert 63 and discharge outlet 66*a*. In communication with nozzle 16 is valve chamber 39. Valve chamber 39 is in direct communication with water channel 21 of stem 12. Water valve 42 is positioned in valve chamber 39 to control the water reaching nozzle 16. Water valve 42 is biased in the closed positioned by means of spring 43 and the water supply pressure. Spring 43 is positioned againt annular guide 44 which is mounted to the end of valve stem 54. Concentrically mounted to annular guide 44 is closure sealing means 46 and "O" ring 47 mounted in front of guide 44. "O" ring 47 prevents the flow of water into the mixture chamber. In the "closed" position, guide 44 is adjacent to, but does not abut, interface 41 of valve chamber 39 and front portion 38.

Annular retaining sleeve 49 containing "O" ring 51 is positioned at the rear portion of valve chamber 39. Annular retaining sleeve 49 is preferably positioned with chamber 39 by means of biased clip 50 which projects into opening 55 as more clearly shown in FIG. 3A. Clip 50 prevents sleeve 49 from being pushed out of chamber 39 by spring 43 or lever handle 14. Retainer sleeve 49 also includes cavity 52 to receive packing material 53 and valve spring 43. Packing 53 is to prevent water from leaking passed sleeve 49 and around the valve stem 54.

Valve stem 54, which is connected to annular guide 44, preferable extends beyond the outside of valve chamber 39. Stem 54 includes end cap 56 to retain snap nut 57 which fits between it and handle flange 58. As can be seen from FIG. 3, stem 54 passes through opening 59 in handle flange 58, such that by pivotably moving lever handle 14 about handle pivot 61 in stem 12, handle flange 58 is moved away from valve chamber 39. Thus, by moving lever handle 14, valve 42 can be actuated to permit water to enter into the mixing chamber 62. Handle flange element **58*a* operates as a stop to position guide 44**.

Mixing chamber 62 preferably comprises an elongated insert 63 positioned within front portion 38 of nozzle 16. Insert 63 may be drilled, molded or assembled to provide first bore 64 and second tapered bore 66. Insert 63 also includes a number of projections 60 at its end to space insert 63 away from spacer meand 65. Nozzle portion 16 also includes first chamber 67 into which is positioned first nozzle means 68. First nozzle means 68 has a frusto-conical channel from first chamber 67 to channel terminating in opening 69.

Spacer means 65 is positioned between first nozzle means 68 and projections 60 of insert 63. Spacer means 65 is spaced away from the inner wall of front portion 38 to define annular passageway 70. Annular passageway 70 is in communication with opening 69 through openings **70*a*. Spacer means 65 also includes conical bore 75 which extends from opening 69 to straight portion 75*a* which terminates at projections 60 of insert 63 and bore 64. Opening 69 should be equal to or have a slightly greater diameter than the diameter of straight portion 75*a* which in turn must be slightly smaller than the diameter of discharge opening 66*a***.

Located at mixing chamber 62 at the entrance to first bore 64 is fluid passageway 71. Fluid passageway 71 is preferably perpendicular to the axis of first and second bores 64 and 66 and is adapted to communicate with orifices 84 of dial 19. Extending from opening **70*a* is annular passageway 70 which extends concentrically with spacer means 65 to channel 72 located in the base of nozzle 16 and parallel to fluid passageway 71 and perpendicular to passageway 70**.

Mounted to the base of nozzle portion 16 by means of screws 73 is fluid container mounting means 74. Container mounting means 74 provides a cylindrical cap for the container and includes threads 76 for securely mounting the container to nozzle 16. Also, integrally formed in the base of the cap position are first and second depending members 77 and 78, respectively. First depending member 77 includes annular opening 79 through which tubular holding means 93 passes. Annular flange 80, which is an integral part of member 77, is adapted to support first retainer biasing spring 82 and "O" ring 81 positioned between the end of spring 82 and flange 80. Second depending member 78 is cylindrically configured to contain second retainer biasing spring 83.

Figure 5:
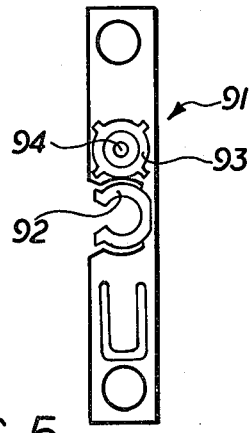
FIG. 5 is a bottom plan view of the retainer means.
Figure 4A:
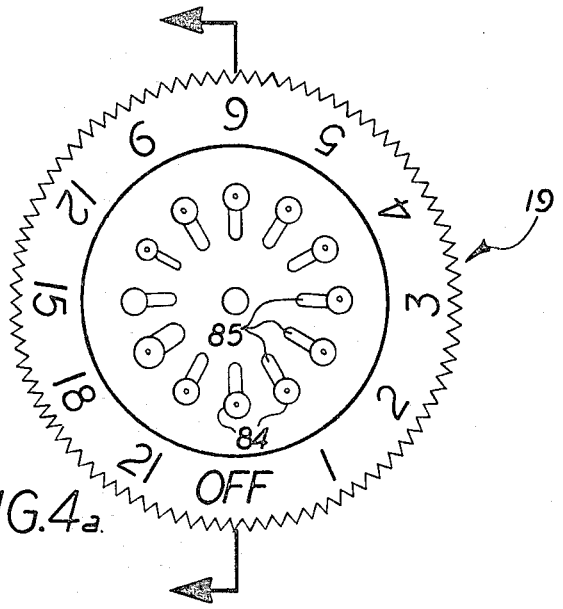
FIG. 4*a* is a top plan view of the selector dial.
Figure 4B:
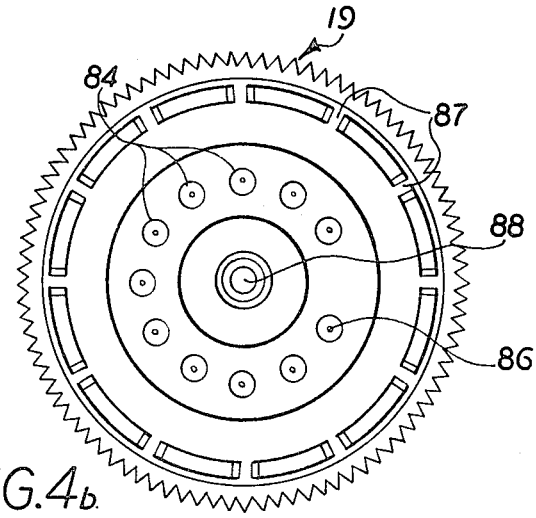
FIG. 4*b* is a bottom plan view of the selector dial.
Figure 4C:
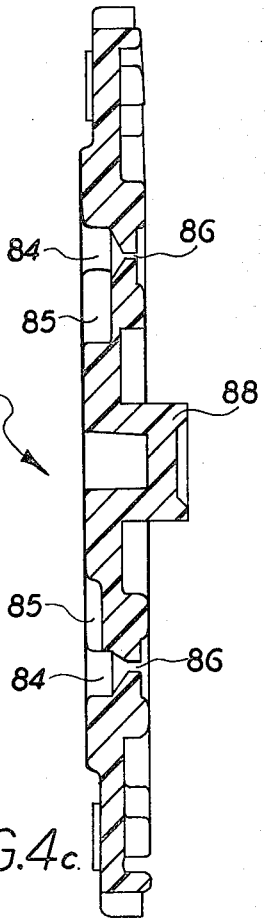
FIG. 4*c* is a sectional elevation of the selector dial.

Positioned between fluid container mounting means 74 and nozzle 16 is selector dial 19 (FIGS. 2 and 4) and retainer 91 (FIG. 5). With reference to FIGS. 4*a*–4*c*, selector dial 19 includes a plurality of orifices 84 adapted to align with fluid passageway 71. Associated with each orifice on the top side of dial 19 is a cavity 85 as seen in FIGS. 4*a* and 4*c*. Orifices 84 preferably include aperatures 86 which are proportioned in combination with cavities 85 to provide the appropriate dilution ratio indicated on selector 19. Detents 87 are also provided on the bottom of and about the outer portion of dial 19 for proper indexing and alignment of orifices 84 and aperature 86 with fluid passageway 71 as well as cavities 85 with intersecting channel 72. Axle 88 is integrally formed on the axis of dial 19 and depends from the bottom to engage retaining means 91 for rotation.

In a presently preferred embodiment the dilution ratios are fixed by the size of cavities 85. For example, for the largest dilution ratio (1 Tsp/gal) cavity is 0.020" wide and 0.062" deep while for the smallest dilution ratio (21 Tsp/gal) cavity 85 is 0.20" wide and 0.020" deep. Obviously, these sizes are illustrative only and depend on numerous factors including the size of aperture 86 which in this example were 0.0145" and 0.033", respectively. In addition to varying the size of cavities 85, aperature 86 or orifices 84 can also be varied.

Retainer means 91 (see FIG. 5) is used to hold dial 19 in place and includes integral "C" clamp 92 to rotatably engage axle 88 of dial 19. Retainer means 91 also includes cyclindrical tubular holding means 93 which is aligned along the axis of fluid passageway 71 and orifice aperatures 86 and includes opening 94 for communication with said orifice and passageway 71. Preferably, inner surface 96 of holding means 93 is tapered to accommodate tube 97 which compressively fits within and extends into container 18. Retaining means 91 also includes indexing flange 98 (FIG. 3) adapted to ride within detents 87 during rotation of dial 19. Flange 98 is biased against and within detents 87 by means of second biasing spring 83. A fluid tight seal is maintained between fluid passageway 71, orifices 84 and opening 94 by means of a FIG. 8 "O" ring 99 and "O" ring 101. First retainer spring 82 biases retainer means 91 against dial 19 and the bottom of nozzle end 16.

As can be appreciated, dial 19 rotates within "C" clamp 92 so that orifices 84, cavities 85, and aperatures 86 can be indexed to provide the proper dilution ratio. As can be seen from FIG. 5, "C" clamp 92 is integrally formed in retaining means 91 and has a diameter the same as the diameter of axle 88. Dial 19 is inserted into the side of mixing head 11 so that axle 88 spreads the arms of "C" clamp 92 which snaps around the axle when completely inserted. Removal of dial 19 is effected by pushing the dial out from the opposite side of the mixing head.

While a presently preferred embodiment of the invention has been shown and described in particularity, it may be otherwise embodied within the scope of the appended claims.

What is claimed:

1. In a multiple dilution ratio hose-end sprayer having a mixing head containing a mixing chamber which includes a sprayer discharge outlet, a means for connecting a water source to said mixing head for supplying water to said mixing chamber, a means for securing a fluid container to said mixing head, passage means for conveying fluid from said container to said chamber and control means for varying the flow of fluid from said container to said chamber, the improvement therein comprising:

a. said mixing chamber being in fluid communication with a fluid inlet means smaller than the sprayer discharge outlet;

b. a rotable control dial having a plurality of orifices and associated cavities, said dial being rotably mounted adjacent said mixing head, said orifices and cavities being positioned on circles concentric with the axis of the dial which intersects the axis of fluid passage means for fluid communication between a selected orifice and said passage means, said cavities being positioned on the surface of the dial adjacent to the mixing head and in communication with said associated orifice;

c. retainer means for biasing said rotatable dial against said mixing means and indexing a selected orifice in communication with said passage means;

d. retainer biasing means; and e. an intersecting channel extending from ahead of said mixing chamber to communicate with the cavity of the associated orifice indexed in communication with said passage means.

2. The improvement in claim 1 wherein said fluid inlet comprises an opening spaced apart from said mixing chamber.

3. The improvement claimed in claim 1 including first nozzle means and a spacer means having a conical channel in communication with the first nozzle means and terminating in a straight channel, said straight channel being in communication with said mixing chamber, both of said means having positioned ahead of the mixing chamber, said spacer means being spaced apart from the inner walls of the mixing head to define an annular passageway therebetween which is in fluid communication with said first nozzle means and said intersecting channel, said straight channel having a diameter less than the discharge outlet of said mixing chamber.

4. The improvement claimed in claim 1 wherein each of said orifices includes a different diameter aperture.

5. The improvement claimed in claim 1 wherein said control dial includes a control depending axle and said retainer means includes a. an integrally formed "C" clamp for rotatably mounting said control dial axle, and b. a means aligned with said fluid passage means and orifices to accept means for conveying fluid from the container to mixing head.

6. The improvement claimed in claim 1 wherein said mixing head includes anti-siphon means.

7. The improvement claimed in claim 5 wherein said control dial includes recesses positioned on the surface thereof adjacent to said retainer means, each of said recesses being associated with an orifice, and projections aligned on said retainer means to cooperate with said recesses to index an associated orifice with said passage means.

8. The improvement claimed in claim 3 wherein said mixing chamber includes insert means spaced away from said spacer means to permit fluid from said passage means to enter said mixing chamber, said insert including a first diametered bore and a tapered bore which extends to substantially the discharge end of said sprayer.

9. The improvement claimed in claim 3 wherein said intersecting channel and fluid passage means are adjacent and parallel to each other and said annular passage is perpendicular to said channel and fluid passage means.

10. The improvement claimed in claim 1 wherein the size of each cavity is proportioned to provide a selected dilution ratio.

11. The improvement claimed in claim 4 wherein the size of each cavity is proportioned in cooperation with the diameter of the aperture of each associated orifice.

* * * * *

UNITED STATES PATENT AND TRADEMARK OFFICE

CERTIFICATE OF CORRECTION

PATENT NO. : 4,475,689

DATED : October 9, 1984

INVENTOR(S) : HARRY L. HAUGER; GLENN I. BEAL

It is certified that error appears in the above-identified patent and that said Letters Patent are hereby corrected as shown below:

Column 1, line 16, after "extensively" delete "ussed" and substitute therefor -- used --;

Column 3, line 20, after "to" delete "rotably" and substitute therefor -- rotatably --;

Column 4, line 19, after "within" delete "in";

Column 4, line 64; after "closed" delete "positioned" and substitute therefor -- position --;

Column 5, line 17, after "44," delete "preferable" and substitute therefor -- preferably --;

Column 5, line 33, after "spacer" delete "meand" and substitute therefor -- means --;

Column 6, line 30, after "85," delete "aperature" and substitute therefor -- aperture --;

Column 6, line 36, delete "aperatures" and substitute therefor -- apertures --;

Column 6, line 50, after "and" delete "aperatures" and substitute therefor -- apertures --;

Column 7, line 10, after "b. a" delete "rotable" and substitute therefor -- rotatable --;

Column 7, line 11, after "being" delete "rotably" and substitute therefor -- rotatably --.

Signed and Sealed this

*Twenty-first* Day of *May 1985*

[SEAL]

*Attest:*

DONALD J. QUIGG

*Attesting Officer* *Acting Commissioner of Patents and Trademarks*